US007013765B2

(12) United States Patent
Chang

(10) Patent No.: US 7,013,765 B2
(45) Date of Patent: Mar. 21, 2006

(54) SECTIONAL ADJUSTABLE SOCKET TOOL HANDLE

(75) Inventor: Peter J. H. Chang, Taipei (TW)

(73) Assignee: Gourmet Equipment (Taiwan) Corporation, Taipei (TW)

( * ) Notice: Subject to any disclaimer, the term of this patent is extended or adjusted under 35 U.S.C. 154(b) by 51 days.

(21) Appl. No.: 10/810,712

(22) Filed: Mar. 29, 2004

(65) Prior Publication Data

US 2005/0109170 A1 May 26, 2005

(30) Foreign Application Priority Data

Nov. 24, 2003 (TW) ..... 92220705 U

(51) Int. Cl.
*B25B 23/16* (2006.01)

(52) U.S. Cl. ..... 81/177.2; 81/177 G; 81/177.85; 81/DIG. 11; 403/325

(58) Field of Classification Search ..... 81/177.2, 81/177 G, 177.85, DIG. 11, 124.4; 403/325, 403/328, 356–358, 361, 329
See application file for complete search history.

(56) References Cited

U.S. PATENT DOCUMENTS 4,480,511 A * 11/1984 Nickipuck ..... 81/124.6
5,813,296 A * 9/1998 Hoff et al. ..... 81/177.85
5,836,223 A * 11/1998 Lin ..... 81/436
6,182,539 B1 * 2/2001 Webster ..... 81/177.2

FOREIGN PATENT DOCUMENTS

TW 122740 11/1989
TW 450181 8/2001

* cited by examiner

*Primary Examiner*—Lee D. Wilson
*Assistant Examiner*—Anthony Ojini
(74) *Attorney, Agent, or Firm*—Birch, Stewart, Kolasch & Birch, LLP

(57) ABSTRACT

A sectional adjustable socket tool handle, which controls the movement of an axial rod along the axial direction of an external pipe. The tool includes a plurality of grooves, a coupler for engaging the plurality of grooves, such that a latch member on the external pipe is latched into the groove under normal conditions, and the coupler can move between a first position and a second position along the axial direction of the external pipe. When the coupler moves to the first position, the coupler will press against the latch member to prevent the axial rod from moving. When the coupler moves to the second position, the coupler will release the latch member.

10 Claims, 3 Drawing Sheets

SECTIONAL ADJUSTABLE SOCKET TOOL HANDLE

This Nonprovisional application claims priority under 35 U.S.C. § 119(a) on Patent Application No(s). 092220705 filed in TAIWAN on Nov. 24, 2003, the entire contents of which are hereby incorporated by reference.

FIELD OF THE INVENTION

The present invention relates to a sectional socket tool handle, and more particularly to a socket wrench that controls an axial rod and an external pipe by a coupler.

BACKGROUND OF THE INVENTION

Wrenches make our life much easier, people can use different wrenches for different working environments according to their needs. There are all kinds of conventional wrenches such as hexagonal wrenches, open wrenches, mobile wrenches, and socket wrenches, etc.

Socket wrenches are divided into fixed socket wrenches and adjustable socket wrenches. The design and application of a socket wrench are described as follows:

1. A fixed socket wrench as disclosed in the R.O.C. Patent No. 450181 entitled "Contractible positioning structure of powerful wrench socket" comprises a wrench body, a rotary section disposed at an end of the wrench body, a rotary coupler with a rectangular cross section connected to the rotary section for connecting sockets of different sizes. When a force is applied to rotate the wrench body, the wrench rotates back and forth in order to save power. However, the wrench body of the prior art has a fixed length, which limits the application of a long-distance force when needed.

2. A contractible wrench as disclosed in the R.O.C. Patent No. 122740 entitled "Improved adjustable handle structure of adjustable socket wrench" comprises a socket wrench body in the shape of a rod and a handle in the shape of a pipe. The wrench body is disposed inside the handle and capable of moving along the axial direction of the handle for adjusting the length of the wrench as needed. However, the conventional adjustable socket wrench not only clamps the fingers easily when the length is adjusted, but is also easy to slip when a force is applied to the wrench.

In view of the shortcomings of the aforementioned prior art, a tool wrench according to this invention is disclosed.

SUMMARY OF THE INVENTION

The primary objective of the present invention is to provide a safe and reliable sectional adjustable socket wrench handle.

The sectional adjustable socket tool handle comprises: an axial rod and an external pipe, wherein the axial rod being disposed in the external pipe and capable of moving along the axial direction of the external pipe, and a plurality of grooves being disposed around the axial rod for latching on the external pipe. A coupler is designed at one end of the external pipe, which moves between a first position and a second position along the axial direction of the external pipe for engaging a plurality of grooves and controlling the operation of the axial rod and the external pipe.

Another objective of the present invention is to adjust the contractible distance of the axial rod and the external pipe according to the user's need to provide an appropriate torque.

A further objective of the present invention is to provide an easy-to-operate sectional adjustable socket tool handle, wherein the coupler for controlling the axial rod and the external pipe can effectively prevent the user's fingers from being clamped, or the wrench from having a slippery engagement.

DETAILED DESCRIPTION OF THE PREFERRED EMBODIMENTS

The detailed description and technical characteristics of the present invention are described with the drawings as follows.

Figure 1:
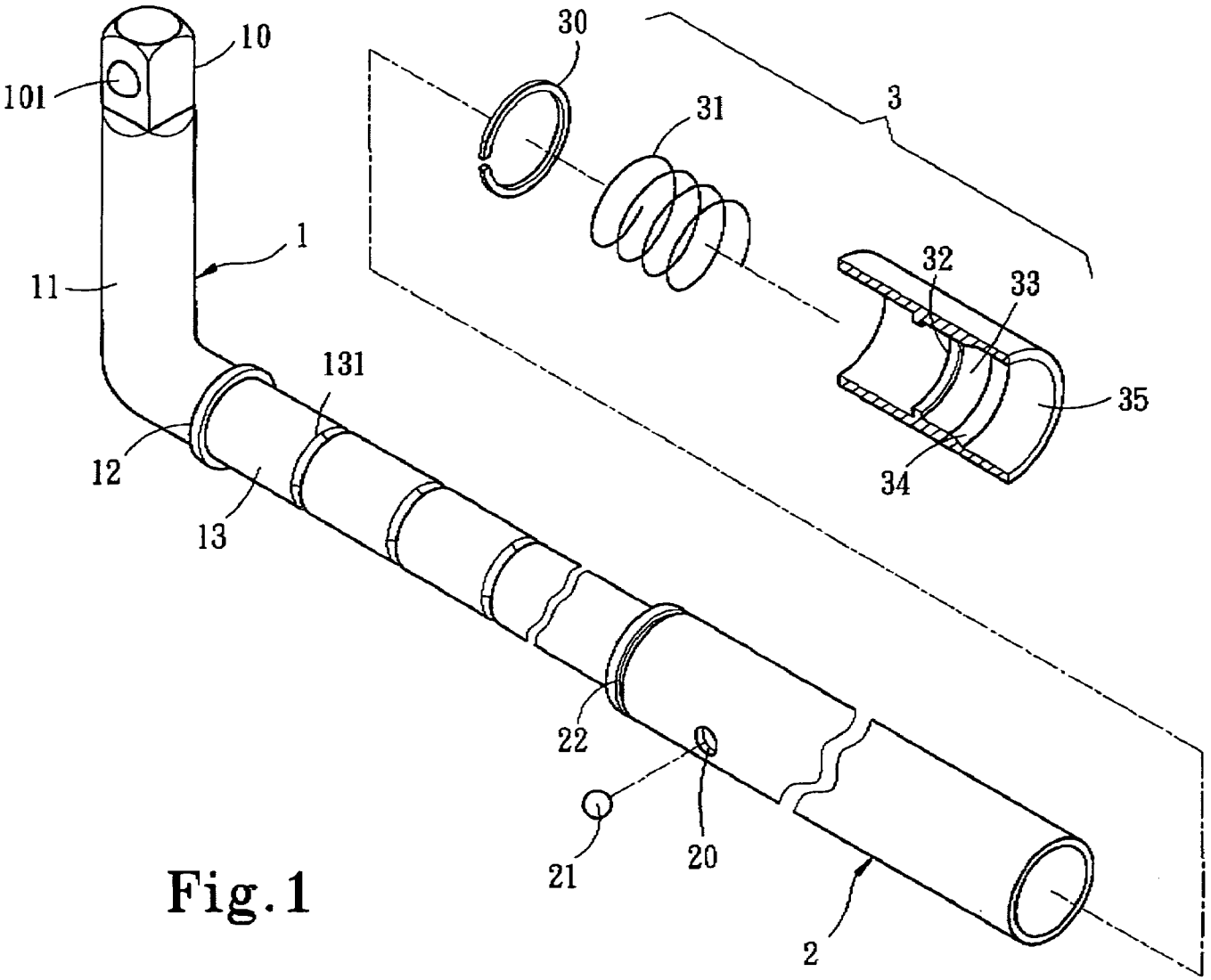
FIG. 1 is a view of the disassembled parts of the sectional adjustable socket tool handle of this invention.

Please refer to FIG. 1 for the sectional adjustable socket tool handle, which comprises: an axial rod 1, having a bent section 11; a connecting section 10 extended from one end of the bent section 11 and using the bent section 11 as a boundary, and the connecting section 10 being a cylinder with a rectangular cross section; a latch member 101 disposed on the connecting section 10 for connecting a socket (not shown in the figure), a blocking section 12 and a main body section 13 being coupled to the other end; and an external pipe 2 having a plurality of apertures 20 and a plurality of latch members 21, such that when the axial rod 1 is disposed inside the external pipe 2 in an open state or a close state, the uppermost edge of the external pipe 2 presses against the blocking section 12.

Figure 2:
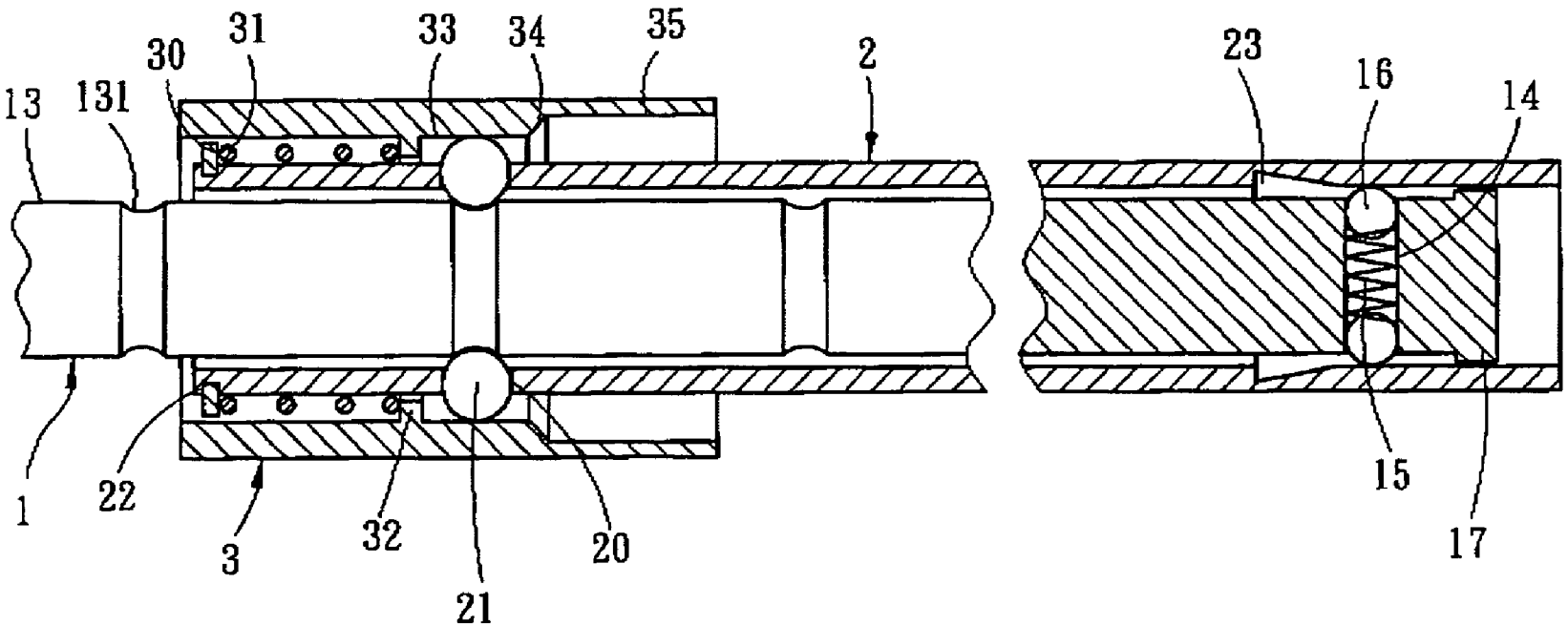
FIG. 2 is a cross-sectional view of the sectional adjustable socket tool handle of this invention.

Please refer to FIGS. 1 and 2 for the movement of the axial rod 1 inside the external pipe 2 controlled by a connecting means which comprises: a through hole 14 passing through the lower edge of the axial rod 1, a resilient member 15 being a spring disposed inside the through hole 14; two latches 16 each being a ball bearing disposed on both sides of the resilient member 15; a second circular groove 23 (substantially disposed on another end of the aperture 20) being disposed on an inner wall of the external pipe 2. When the axial rod 1 moves along the axial direction of the external pipe 2 and extends outward to a maximum distance, the latch member 16 is pushed towards the second circular groove 23 by the tension of the resilient member 15 to press against the second circular groove 23, so that the axial rod 1 and the external pipe 2 will not be separated from each other. A base 17 is disposed at the bottom of the axial rod 1 for securing the axial rod 1 and preventing it from swinging or shaking when the axial rod 1 and the external pipe 2 move along the axial direction.

A plurality of grooves 131 are disposed equidistant from each other around a main body section 13 of the axial rod 1; a plurality of apertures 20 are disposed around the circumference of the external pipe 2; and a plurality of latch members 21 is disposed at the plurality of apertures 20 respectively, such that when the axial rod 1 moves along the axial direction of the external pipe 2 to latch a groove 131 and adjust the contractible distance of the axial rod 1 and the external pipe 2 as needed.

Figure 3A:
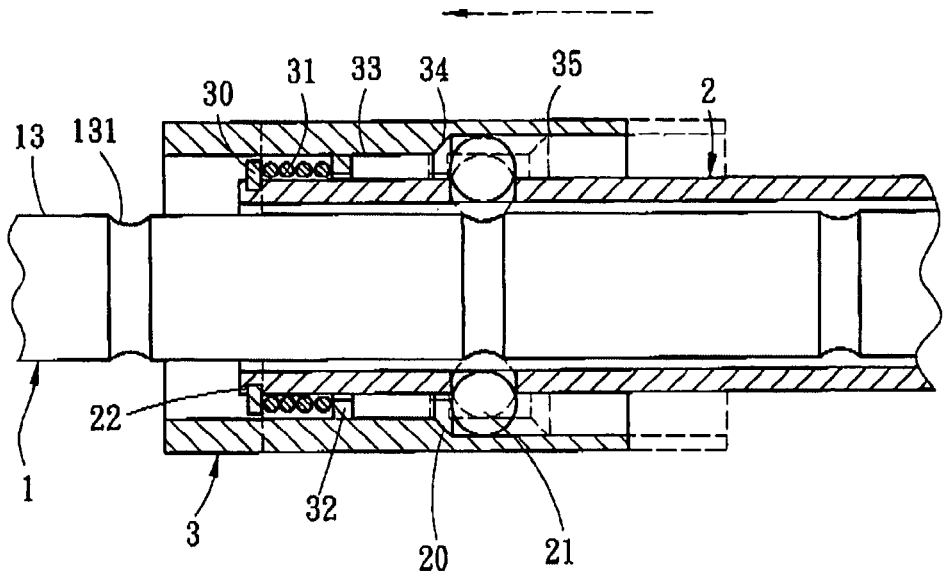
FIGS. 3A and 3B are views showing the movements of sectional adjustable socket tool handle of this invention.

A coupler 3 is a movable hollow pipe installed around the circumference of the external pipe 2 and surrounding the foregoing plurality of apertures 20 and having a resilient member 31 disposed inside the coupler 3. The resilient member 31 is a spring with one end being fixed into a first circular groove 22 of the external pipe 2 by a fixture 30, which is a latch ring, and the other end pressing against the latch section 32 inside the coupler 3. The coupler 3 has a compressing section 33 and a releasing section 35. When the foregoing latch member 21 latches the groove 131 under normal conditions, the coupler 3 can move along the axial direction of the external pipe 2 between a first position and a second position as shown in FIG. 2. The compressing section 33 presses against the latch member 21 for restricting the movement of the axial rod 1. When a coupler 3 moves to the second position as shown in FIG. 3A, the releasing section 35 releases the latch member 21, and thus the axial rod 1 can move freely. Further, the compressing section 33 and the releasing section 35 individually have a slanting surface 34 for facilitating the latch member 21 to slide between the compressing section 33 and the releasing section 35 while the coupler 3 is moving.

Figure 3B:
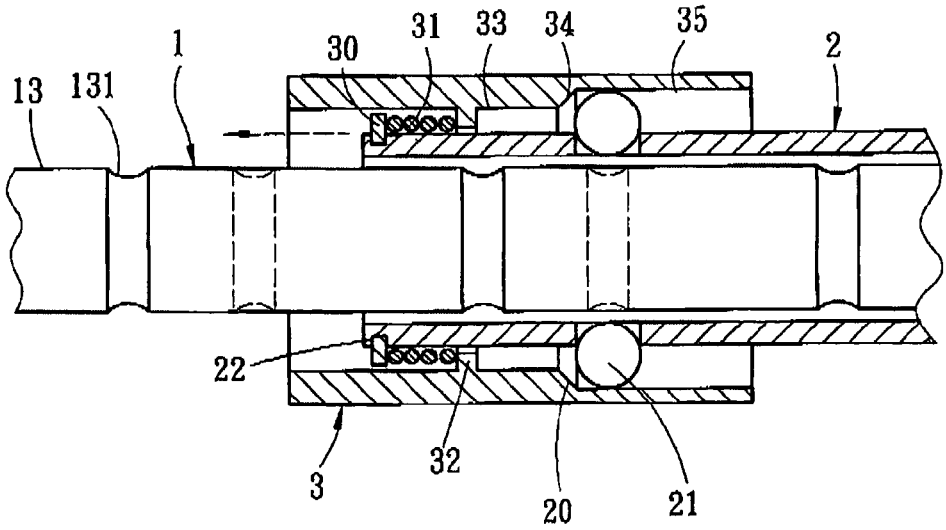

Please refer to FIGS. 3A and 3B again. Under normal conditions, the coupler 3 moves along the axial direction of the external pipe 2 between the first position and the second position. When the coupler 3 moves to the second position as shown in FIG. 3A, the releasing section 35 will release the latch member 21, and latch member 21 remains being latched with the groove 131 at that time. Under abnormal conditions, the axial rod 1 can freely move along the axial direction of the external pipe 2 as shown in FIG. 3B, since the latch member 21 is positioned at the releasing section 35.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A sectional adjustable socket tool handle, having an axial rod and an external pipe for controlling an axial movement of said axial rod inside said external pipe, comprising:

a through hole, disposed at an end of said axial rod for receiving a first resilient member, and said first resilient member having two first latch members on opposite ends, a first circular groove disposed on an inner wall of said external pipe, so that the tension of said first resilient member pushes said first latch members into said first circular groove when said axial rod extends outwardly to a maximum distance along an axial direction of said external pipe;

a plurality of grooves disposed around said axial rod and a plurality of apertures disposed around a circumference of said external pipe and second latch members being disposed at said apertures for latching one of said plurality of grooves when said axial rod moves along the axial direction of said external pipe; and a coupler being a movable hollow pipe installed around the circumference of said external pipe and surrounding said plurality of apertures for accommodating a second resilient member therein, such that an end of said second resilient member is fixed into a second circular groove by a fixture and the other end presses against a blocking section of said coupler; said coupler having a compression section and a releasing section, and when said second latch members are latched into said groove under normal condition, said coupler moves between a first position and a second position along the axial direction of said external pipe, and when said coupler moves to said first position, said compressing section presses against said second latch members, and when said coupler moves to said second position, said releasing section releases said second latch members.

2. The sectional adjustable socket tool handle of claim 1, wherein said axial rod has a base.

3. The sectional adjustable socket tool handle of claim 2, wherein said base is used for securing said axial rod.

4. The sectional adjustable socket tool handle of claim 1, wherein said first resilient member is a spring.

5. The sectional adjustable socket tool handle of claim 1, wherein said first latch member is a bearing.

6. The sectional adjustable socket tool handle of claim 1, wherein said plurality of grooves are equidistant from each other.

7. The sectional adjustable socket tool handle of claim 1, wherein a relative positioning between said axial rod and said external pipe is determined by which groove receives said second latch members.

8. The sectional adjustable socket tool handle of claim 1, wherein said grooves are in a curved shape.

9. The sectional adjustable socket tool handle of claim 1, wherein said compressing section and releasing section have a slanting surface therebetween.

10. The sectional adjustable socket tool handle of claim 9, wherein said slanting surface facilitates the movement of said second latch member to move between said compressing section and said releasing section.

* * * * *